US010357724B2

(12) United States Patent
Todokoro

(10) Patent No.: US 10,357,724 B2
(45) Date of Patent: Jul. 23, 2019

(54) TRANSMITTER

(71) Applicant: AGATSUMA CO., LTD, Tokyo (JP)

(72) Inventor: Shinji Todokoro, Tokyo (JP)

(73) Assignee: Agatsuma Co., Ltd., Tokyo (JP)

( * ) Notice: Subject to any disclaimer, the term of this patent is extended or adjusted under 35 U.S.C. 154(b) by 0 days.

(21) Appl. No.: 15/434,941

(22) Filed: Feb. 16, 2017

(65) Prior Publication Data

US 2017/0291113 A1 Oct. 12, 2017

(30) Foreign Application Priority Data

Apr. 6, 2016 (JP) ..... 2016-076317

(51) Int. Cl.

| | |
|---|---|
| ***A63H 30/04*** | (2006.01) |
| ***A63H 27/00*** | (2006.01) |
| ***A63H 29/24*** | (2006.01) |
| ***A63H 29/18*** | (2006.01) |
| ***A63H 29/22*** | (2006.01) |
| ***G05G 9/047*** | (2006.01) |

(52) U.S. Cl.

CPC ..... *A63H 29/24* (2013.01); *A63H 27/12* (2013.01); *A63H 29/18* (2013.01); *A63H 29/22* (2013.01); *A63H 30/04* (2013.01); *G05G 9/047* (2013.01); *G05G 2009/0477* (2013.01)

(58) Field of Classification Search

CPC ..... A63H 27/04; A63H 27/12; A63H 30/00; A63H 30/04

See application file for complete search history.

(56) References Cited

U.S. PATENT DOCUMENTS 2,860,447 A * 11/1958 Muller ..... A63H 30/00 446/232
4,912,997 A 4/1990 Malcolm
5,841,372 A * 11/1998 Matsumoto ..... A63F 13/02 341/20
6,805,020 B2 * 10/2004 Onodera ..... G05G 9/047 345/161

(Continued)

FOREIGN PATENT DOCUMENTS

CN 201091797 Y 7/2008
JP 2000-024333 A 1/2000

(Continued)

OTHER PUBLICATIONS

European Search Report from the European Patent Office in Application No. 17152216.2-1658 dated Aug. 17, 2017.

*Primary Examiner* — Eugene L Kim
*Assistant Examiner* — Alyssa M Hylinski
(74) *Attorney, Agent, or Firm* — The Marbury Law Group, PLLC

(57) ABSTRACT

There is provided a transmitter for facilitating control of a flying object including an elevation control lever 22 for controlling a flight height of a helicopter 1, a cover 24 through which the elevation control lever 22 passes via an opening 26, a step 27 formed on an edge of the opening 26, and a rotation member 28, which rotates, disposed to a backside of the cover 24, where apart of the cover 24 is formed into a curved surface which overlaps a curved surface of the rotation member 28, and rotational speeds of motors 11, 12 internally mounted on the helicopter 1 are set corresponding to the step 27.

10 Claims, 8 Drawing Sheets

(56) References Cited

U.S. PATENT DOCUMENTS

| | | | | |
|---|---|---|---|---|
| 8,287,326 | B2 * | 10/2012 | Huang | A63H 30/04 446/31 |
| 8,639,400 | B1 * | 1/2014 | Wong | A63H 30/04 244/17.13 |
| 9,650,155 | B2 * | 5/2017 | Wang | B64D 47/08 |
| 2005/0121553 | A1 * | 6/2005 | Isawa | A63H 27/12 244/17.19 |
| 2010/0302017 | A1 | 12/2010 | Guglielmo | |
| 2011/0300942 | A1 * | 12/2011 | Jaouen | A63F 13/803 463/38 |
| 2012/0258645 | A1 * | 10/2012 | Cheng | A63H 27/004 446/37 |
| 2014/0094310 | A1 * | 4/2014 | Bleich | A63F 13/02 463/38 |
| 2014/0111317 | A1 * | 4/2014 | Shen | A63H 30/04 340/12.22 |
| 2016/0124458 | A1 * | 5/2016 | Yamaguchi | G05G 5/03 74/523 |

FOREIGN PATENT DOCUMENTS

| | | | | |
|---|---|---|---|---|
| JP | 2014-064914 | A | | 4/2014 |
| KR | 99051113 | A | * | 7/1999 |
| WO | 2012/155409 | A1 | | 9/2011 |

* cited by examiner

TRANSMITTER

CROSS-REFERENCE TO RELATED APPLICATION

This application is based upon and claims the benefit of priority under 35 USC 119 of Japanese Patent Application No. 2016-076317 filed on Apr. 6, 2016, the entire disclosure of which, including the description, claims, drawings, and abstract, is incorporated herein by reference.

BACKGROUND OF THE INVENTION

Field of the Invention

The present invention relates to a transmitter for remotely controlling a flying object.

Description of the Related Art

There have been transmitters for remotely controlling toy or model flying objects such as helicopters. For example, Japanese Unexamined Patent Publication No. 2000-24333 discloses a transmitter for remotely controlling a toy helicopter. The transmitter is provided with an elevation control lever for controlling climbing and descending movements and a direction control lever for controlling traveling direction of the toy helicopter. Inclining the elevation control lever upward or downward makes the toy helicopter climb vertically or descend respectively. In addition, tilting the direction control lever upward or downward makes the helicopter travel forward or backward, and tilting the direction control lever leftward or rightward makes the helicopter turn to the left or right, respectively.

Japanese Unexamined Patent Publication No. 2014-64914 discloses a helicopter whose infrared ray LED transmits a position control signal toward reflecting surfaces such as walls or ground, and a receiver of the helicopter receives the signal reflected by the surfaces. When the signal reflected by the surfaces is received by the receiver, a level of the signal is obtained by the receiver. The receiver of the helicopter communicates with a transmitter for adjusting and controlling speed and flight direction of the helicopter.

However, an art disclosed in Japanese Unexamined Patent Publication No. 2000-24333 has a downside. The helicopter climbs or descends when the elevation control lever is operated upward or downward. However, the helicopter will crash into a ceiling or ground when the elevation control lever is operated too quickly. Particularly, hovering (the flying object stays in the air with maintaining a constant height) and landing are very difficult for children.

In addition, in an art disclosed in Japanese Unexamined Patent Publication No. 2014-64914, a flight height of the helicopter is maintained with transmitting and receiving the infrared ray. However, this leads to increased weight of the helicopter and costs for manufacturing the helicopter and the transmitter.

SUMMARY OF THE INVENTION

An object of the present invention is to provide a transmitter that facilitates control of a flying object.

A transmitter of the present invention includes a lever for controlling a flight height of the flying object, a cover that has an opening through which the lever passes, and a step formed on an edge of the opening.

With the present invention, control of the flying object is facilitated.

DETAILED DESCRIPTION OF THE PREFERRED EMBODIMENT

Figure 1:
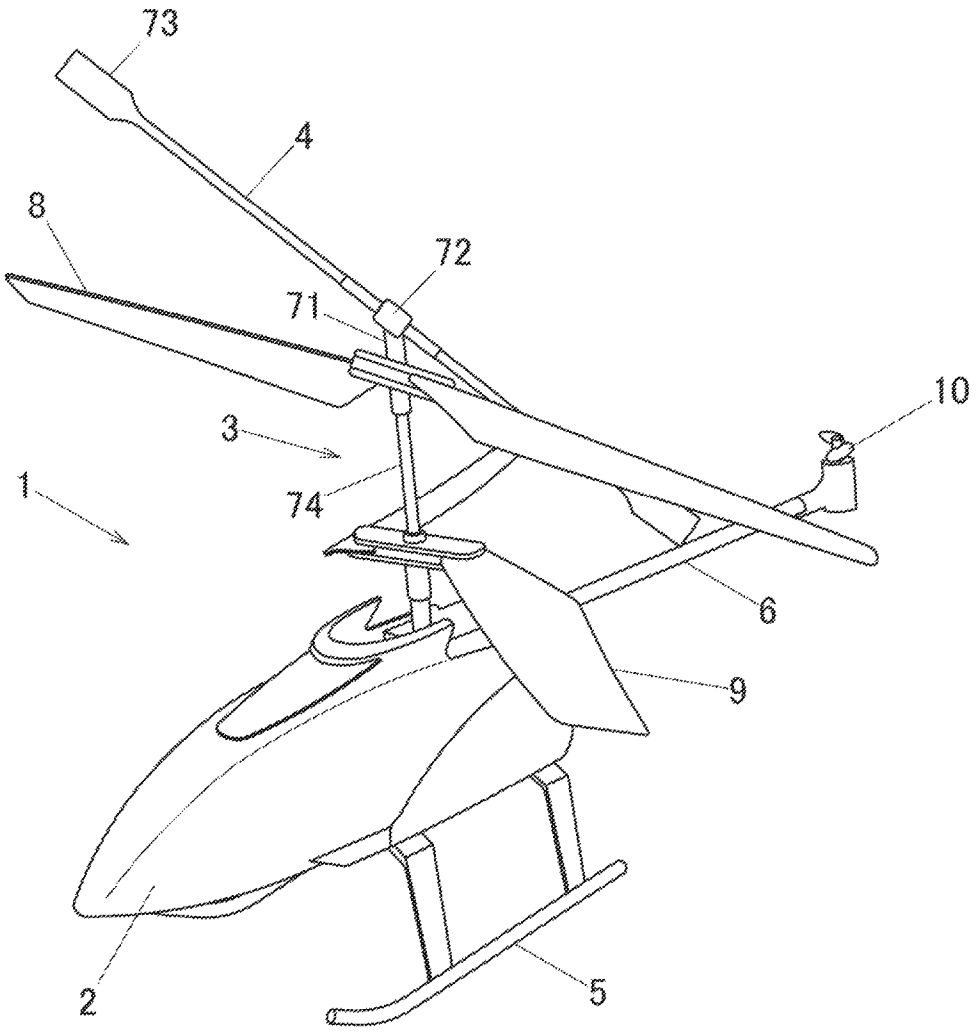
FIG. 1 is a perspective view of a helicopter according to an embodiment of the present invention.
Figure 2:
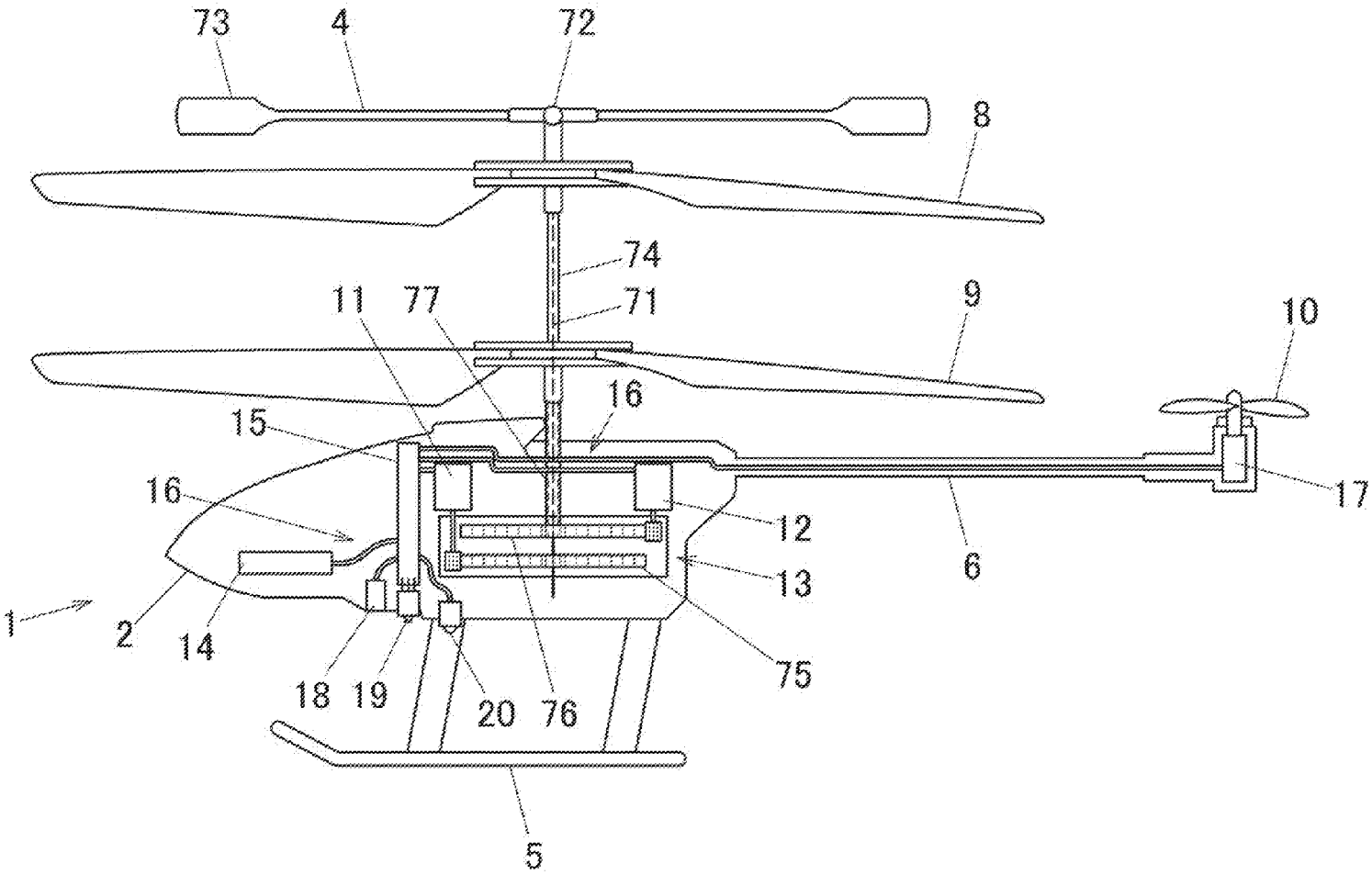
FIG. 2 is a cross sectional view of the helicopter according to the embodiment of the present invention.

Hereinafter, an embodiment of the present invention will be described by use of the accompanying drawings. FIG. 1 is a perspective view of a helicopter 1 according to an embodiment of the present invention. FIG. 2 is a cross sectional view of the helicopter 1 according to the embodiment of the present invention. A user can play with the helicopter 1, which is a toy flying object, using a transmitter 21 shown in FIGS. 3, 4 by making the helicopter 1 fly upward/downward, forward/backward, and leftward/rightward.

The helicopter 1 includes a body 2, rotor 3, a stabilizer 4, a landing member 5, and a tail part 6, as shown in FIG. 1. The rotor 3 includes an upper rotor 8 and a lower rotor 9, and is installed rotatably on a top part of the body 2. A propeller 10 is disposed to a distal end of the tail part 6.

The body 2 is internally provided with a first motor 11 for rotationally driving the upper rotor 8, a second motor 12 for rotationally driving the lower rotor 9, and a rotation transmission member 13 for transmitting drive force of the motors 11, 12, to each rotor 8, 9 respectively as shown in FIG. 2.

A pinion gear disposed to a drive shaft of the first motor 11 meshes with a gear 75. The gear 75 is fixed to a bottom side of a rotor shaft 71. The upper rotor 8 is fixed to a top side of the rotor shaft 71.

A pinion gear disposed to a drive shaft of the second motor 12 meshes with a gear 76. The gear 76 is disposed above the gear 75 co-axially. The gear 76 is fixed to a bottom side of a rotor shaft 74. The lower rotor 9 is fixed to an intermediate position of the rotor shaft 74. The rotor shaft 74 is extended to a vicinity of the upper rotor 8.

The rotor shaft 74 is formed in a tubular shape, and into which the rotor shaft 71 is inserted. A pipe 77 is formed on an outer periphery of the rotor shaft 74, which is arranged vertically on the body 2, so as to support the rotor shaft 74 rotatably. Therefore, the rotor shaft 71 and the rotor shaft 74 are inserted into the pipe 77.

Rotor blades of the upper rotor 8 and the lower rotor 9 are designed so as to be turned in opposite directions to each other. The helicopter 1 is designed in such a way that when rotational speed of the upper rotor 8 is faster than that of the lower rotor 9, the helicopter 1 turns to the left, and when rotational speed of the lower rotor 9 is faster than that of the upper rotor 8, the helicopter 1 turns to the right.

When the rotational speeds of the upper rotor 8 and the lower rotor 9 become faster simultaneously, the helicopter 1 takes off or climbs, and when the rotational speeds of the upper rotor 8 and the lower rotor 9 become slower simultaneously, the helicopter 1 descends or lands on the ground.

A stabilizer 4 is a cylindrical bar-shaped member, which is fixed to the rotor shaft 71 of the upper rotor 8 with a stabilizer shaft 72 above the upper rotor 8, and the stabilizer 4 is installed so as to define e.g. a 30 to 90 degree intersection angle with the upper rotor 8. Weights 73 are formed at both ends of the stabilizer 4. The landing member 5 is disposed to a bottom of the body 2 for stable landing of the helicopter 1.

A motor 17 is internally provided to a distal end of the tail part 6 for rotationally driving the propeller 10. A rechargeable battery 14 and a substrate 15 are internally provided to the body 2. The rechargeable battery 14 is charged with a USB cable which connects between a personal computer or the like and a terminal 18 of the body 2. The substrate 15 has a control circuit, which includes a receiver circuit. A power switch 19 is provided to the bottom of the body 2. A photoreceiver 20 for the receiver circuit, which receives a control signal from a transmitter, is disposed in a vicinity of the power switch 19. The substrate 15 is connected to the motors 11, 12, 17, the rechargeable battery 14, the terminal 18, and the photoreceiver 20 of the receiver circuit.

The substrate 15 has a control circuit for analyzing the control signal from the transmitter 21 received by the photoreceiver 20, and controls electric power supplied from the rechargeable battery 14 to the first motor 11, second motor 12, and the motor 17. As mentioned heretofore, the control circuit of the substrate 15 controls the rotational speeds of the upper rotor 8, lower rotor 9, and the propeller 10 for achieving height adjustment, takeoff/landing, forward/backward movement, left/right turn, and hovering of the helicopter 1.

Figure 3:
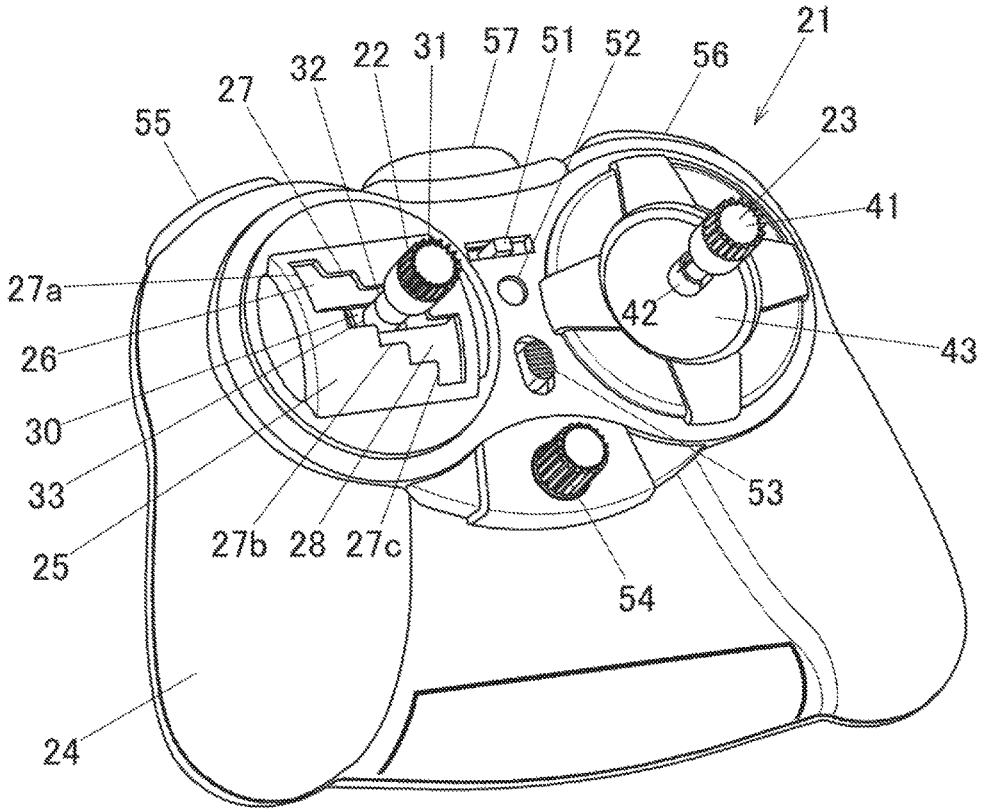
FIG. 3 is a perspective view of a transmitter according to the embodiment of the present invention.
Figure 4:
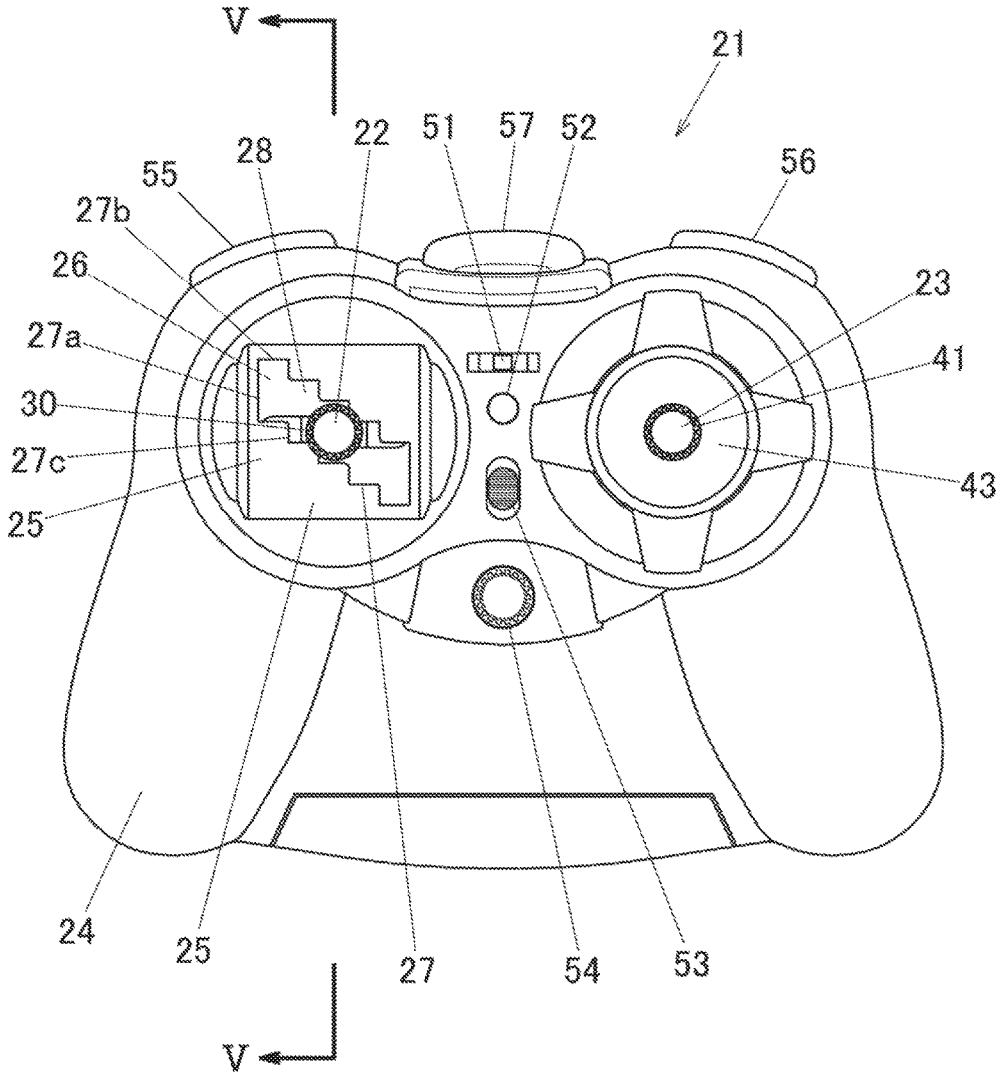
FIG. 4 is a front view of the transmitter according to the embodiment of the present invention.

FIG. 3 is a perspective view of the transmitter 21 according to the embodiment of the present invention. FIG. 4 is a front view of the transmitter 21 according to the embodiment of the present invention. In descriptions hereinafter, "left and right" means a horizontal direction in the front view of FIG. 4, and "up and down" means a vertical direction in the front view of FIG. 4.

An elevation control lever 22 is arranged at a top left side, and a flight control lever 23 is arranged at a top right side of the transmitter 21. The helicopter 1 climbs when the elevation control lever 22 is tilted to an upper left direction, and the helicopter 1 descends when the elevation control lever 22 is tilted to a lower right direction. The helicopter 1 flies forward/backward when the flight control lever 23 is tilted to an up/down direction, and the helicopter 1 turns to the left/right when the flight control lever 23 is tilted to a left/right direction, respectively.

The elevation control lever 22 is disposed to a convex part 25, which is a part of a cover 24 of the transmitter 21. The convex part 25 may not necessarily be a part of the cover 24, but may be formed separately. The convex part 25 is formed into a convex-shaped curved surface toward outside and both left and right side surfaces are slanted. An opening 26 is defined on the curved surface of the convex part 25 and is formed into five-step shape ascending from right to left.

Figure 5:
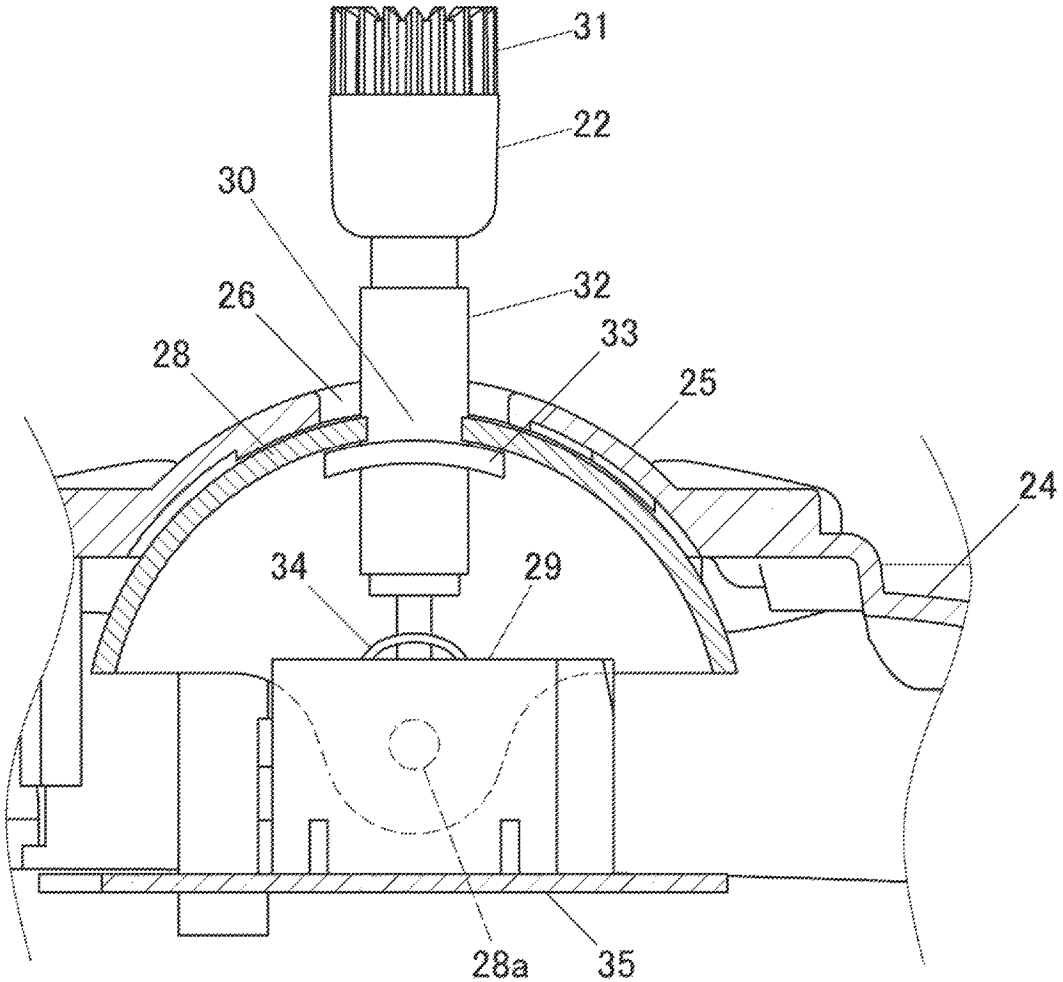
FIG. 5 is a cross sectional view of a main part taken along line V-V of FIG. 4 showing an elevation control lever according to the embodiment of the present invention.

FIG. 5 is a cross sectional view of a main part taken along line V-V of FIG. 4 showing an elevation control lever according to the embodiment of the present invention. A rotation member 28 is disposed to a backside of the curved surface of the convex part 25 of the cover 24. The rotation member 28 has a curved surface that has the same curvature as the curved surface of the convex part 25. Across sectional shape of the curved surface of the rotation member 28 is semicircular. The rotation member 28 is rotatable to an up/down direction with a rotation axle **28*a* being supported rotatably. A cutout 30 extending to a left/right direction is defined on the curved surface of the rotation member 28**.

The elevation control lever 22 has a head part 31 and a stick part 32, both of which have a cylindrical shape. The head part 31 is larger than the stick part 32 in diameter. A periphery of an end of the head part 31 is formed uneven for preventing user's fingers from slippery.

Perpendicular width of the cutout 30 is slightly larger than a diameter of the stick part 32 of the elevation control lever 22, and a lateral width of the cutout 30 equals to distance between left and right ends of the opening 26. The left and right ends of the cutout 30 are formed semicircular shape. The stick part 32 of the elevation control lever 22 passes through the cutout 30. A rectangular plate body 33 is formed on a lower part of the stick part 32 at a backside of the cutout 30 (shown in FIG. 5). The plate body 33 has a curved surface.

A proximal end of the stick part 32 is connected to a shaft of a support part 29 disposed to an inside of the transmitter 21. When the elevation control lever 22 is tilted to an up/down direction, the elevation control lever 22 remains tilted. Meanwhile, the elevation control lever 22 returns to a center position due to restoring force of an elastic member 34 disposed to the support part 29 when the elevation control lever 22 is tilted to a left/right direction.

The elevation control lever 22 is an operating member for controlling the aforementioned motors 11, 12 for rotationally driving the respective rotors 8, 9 of the body 2 evenly in order to control a flight height of the helicopter 1. The elevation control lever 22 is connected to a substrate 35 via the support part 29. The rotational speed of the respective motors 11, 12 is increased by tilting the elevation control lever 22 to the upper left direction. The rotational speed of the respective motors 11, 12 is decreased by tilting the elevation control lever 22 to the lower right direction. The motors 11, 12 are stopped by tilting the elevation control lever 22 to a bottom end position.

The flight control lever 23 has a head part 41 and a stick part 42, both of which have a cylindrical shape, as shown in FIGS. 3, 4. The flight control lever 23 is in a center position of a semicircular rotation member 43 when in a neutral state. The head part 41 is larger than the stick part 42 in diameter. A periphery of a distal end of the head part 41 is formed uneven for preventing user's fingers from slippery.

The stick part 42 of the flight control lever 23 passes through the rotation member 43 to reach a backside thereof. A bottom end of the stick part 42 is connected to a shaft of a support part (not shown) disposed to an inside of the transmitter 21. The flight control lever 23 returns to a center position due to restoring force of an elastic member disposed to the support part when the flight control lever 23 is tilted forward/backward and then released. Similarly, the flight control lever 23 returns to the center position due to the restoring force of the elastic member disposed to the support part when the flight control lever 23 is tilted to the left/right direction and then released.

The flight control lever 23 is an operating member for turning the propeller 10 of the tail part 6 in a positive/negative direction in order to control forward/backward movement of the helicopter 1 by the flight control lever 23 being tilted to the up/down direction. The flight control lever 23 is connected to the substrate 35 via a support part (not shown). When the flight control lever 23 is tilted upward, the motor 17 is supplied with increased electric power for turning the propeller 10 in the positive direction. Whereby the tail part 6 is raised and a front end of the body 2 is lowered, thus the helicopter 1 flies forward. When the flight control lever 23 is tilted downward, the motor 17 is supplied with increased electric power for turning the propeller 10 in the negative direction. Whereby the tail part 6 is lowered and the front end of the body 2 is raised, thus the helicopter 1 flies backward.

In addition, the flight control lever 23 is also an operating member for controlling the motors 11, 12 for driving the upper rotor 8 and the lower rotor 9 in different speed respectively in order to control a turning direction of the helicopter 1 by the flight control lever 23 being tilted to the left/right direction. When the flight control lever 23 is tilted left, the first motor 11 is supplied with increased electric power for turning the upper rotor 8, thus the helicopter 1 turns to the left. When the flight control lever 23 is tilted right, the second motor 12 is supplied with the increased electric power for turning the lower rotor 9, thus the helicopter 1 turns to the right.

The transmitter 21 includes a channel switch 51, a power lamp 52, a power switch 53, and an adjustment dial 54 in between the elevation control lever 22 and the flight control lever 23. The channel switch 51 switches frequency of a signal transmitted from the transmitter 21 to three different frequencies. The power switch 53 switches ON/OFF of a power supply. The power lamp 52 glows or flashes when the power switch 53 is set to ON.

The adjustment dial 54 is an operating member for adjusting the rotational speeds of the upper rotor 8 and the lower rotor 9 to match by controlling electric power supplied to each of the aforementioned first motor 11 and the second motor 12 in order to maintain the helicopter 1 stationary in the air. The adjustment dial 54 is rotatably installed to a main body housing and connected to the substrate 35 of the transmitter 21. Flight height adjustment parts 55, 56 are disposed to left and right top ends of the transmitter 21 respectively, and an antenna 57 (infrared oscillation part) is disposed to a center of the top end of the transmitter 21. The flight height adjustment part 55 adjusts a reference height (e.g. a hovering height) to low, and the flight height adjustment part 56 adjusts the reference height to high. The antenna 57 is not limited to oscillate infrared ray, but may transmit e.g. a radio wave.

Figure 6:
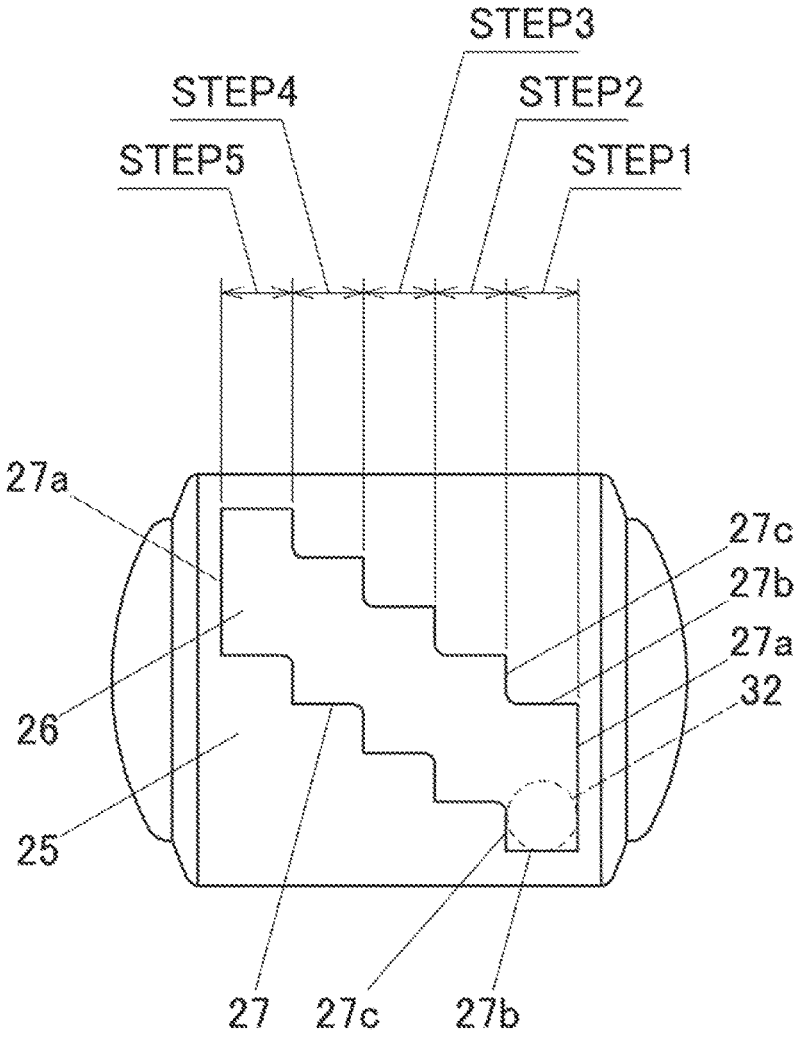
FIG. 6 is an enlarged view of a main part of a step according to the embodiment of the present invention.

FIG. 6 is an enlarged view of a main part of a step 27 formed at an edge of the opening 26 according to the embodiment of the present invention. Long perpendicular sides 27*a* are formed at left and right end sides of the step 27. The step 27 includes lateral sides 27*b*, which are parallel on upper and lower sides, and short perpendicular sides 27*c*, in such a way that both sides 27*b* and 27*c* are arranged alternately. The perpendicular sides 27*a*, 27*c* and the lateral sides 27*b* are arranged adjacently to meet at right angles. Corners in the step 27 are chamfered and rounded.

The step 27 includes five steps from a step 1 to a step 5 arranged in a stepwise shape ascending from right to left. The stick part 32 of the elevation control lever 22 is at a bottom end of the step 1. The number of step positions in the step 27 is not limited to five of the steps 1 to 5 but may be any step or steps including a single step. A shape of the step 27 is not limited to the stepwise shape described in the embodiment but may be a different shape. For example, an opening 26 shown in FIG. 6 is defined to have both upper side steps and lower side steps. However, the steps may be formed at one side only, either the upper side or the lower side. In addition, the step 27 is not limited to be ascending from right to left, but may be ascending from left to right.

In a pathway of the elevation control lever 22 from the step 1 to step 5, the elevation control lever 22 can be tilted with contacting either of the upper side or the lower side step surface. When the elevation control lever 22 is tilted from the step 5 to step 1, the elevation control lever 22 is tilted in the same way. In addition, the elevation control lever 22 can be tilted in a space between the upper and lower lateral sides 27*b* in one step.

Figure 7:
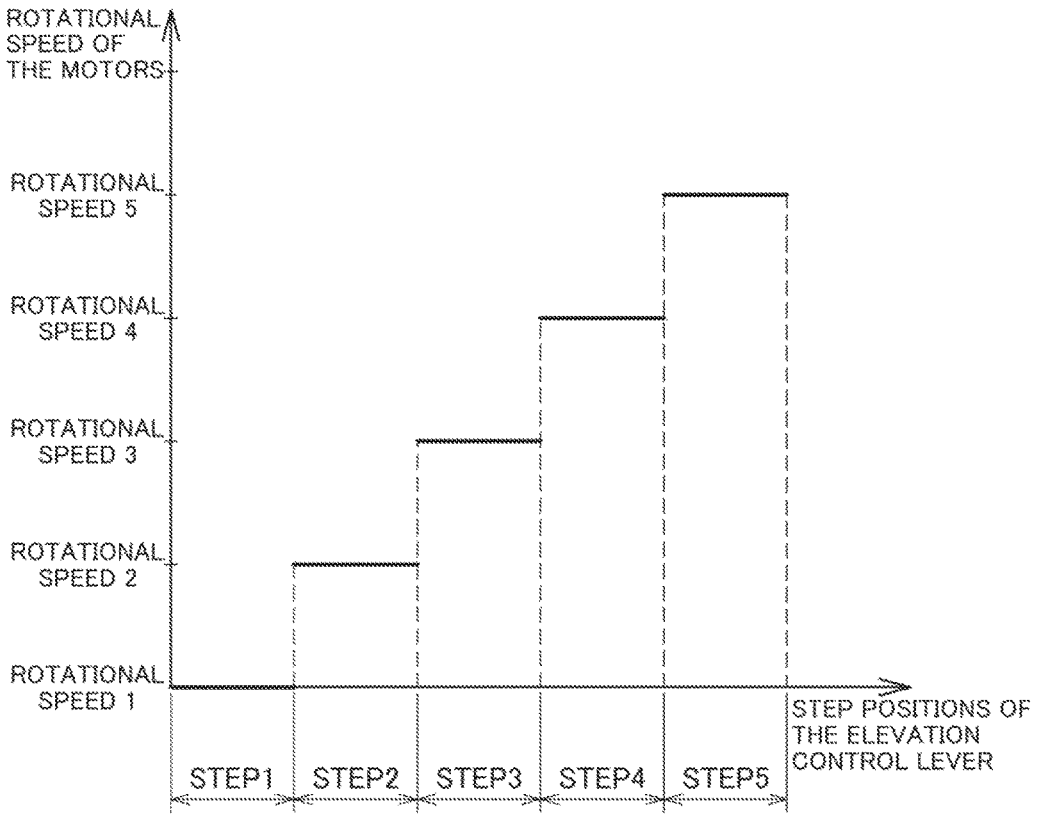
FIG. 7 shows a relationship between a step position of the elevation control lever and rotational speed of a motor according to the embodiment of the present invention.

FIG. 7 shows a relationship between the step positions of the elevation control lever 22 in the step 27 and the rotational speeds of the motors. When the stick part 32 of the elevation control lever 22 is tilted to the step 1, the each rotational speed of the motors 11, 12 is set to rotational speed 1. The rotational speed of the rotational speed 1 for the motors 11, 12 is set to zero. Therefore the motors 11, 12 are not activated. When the stick part 32 of the elevation control lever 22 is tilted to the step 2, the each rotational speed of the motors 11, 12 is set to rotational speed 2. In the rotational speed 2, the motors 11, 12 are activated and rotated at prescribed speed.

When the stick part 32 of the elevation control lever 22 is tilted to the step 3, the each rotational speed of the motors 11, 12 is set to rotational speed 3. In the rotational speed 3, the motors 11, 12 are rotated at prescribed speed that is higher rotational speed than that of the rotational speed 2. When the stick part 32 of the elevation control lever 22 is tilted to the steps 4, 5, the each rotational speed of the motors 11, 12 is set as well to rotational speeds 4, 5 respectively. As described heretofore, the rotational speeds of the motors 11, 12 are set corresponding to the steps 1 to 5 which are step positions in the step 27.

Consequently, when the elevation control lever 22 is at a position of the step 4, the rotational speeds of the motors 11, 12 can be set at which the helicopter 1 hovers. A step position for the hovering is not limited to the step 4 but any of the other steps may be used with the corresponding rotational speeds of the motors 11, 12 being set to enable the helicopter 1 to hover. In this embodiment, the rotational speeds of the motors are set uniform at the each step. However, the rotational speeds may be set to be varied within a prescribed speed range corresponding to a perpendicular position of the elevation control lever 22 in a space between the upper and lower sides of the each step.

Next, operation methods for the hovering and landing of the helicopter 1 using the transmitter 21 will be described. FIG. 8A to 8E show step positions of the elevation control lever 22 of the transmitter 21 according to the embodiment of the present invention. First, by setting the power switch 19 of the body 2 and the power switch 53 of the transmitter 21 to ON, the power lamp 52 flashes first and then glows.

Figure 8A:
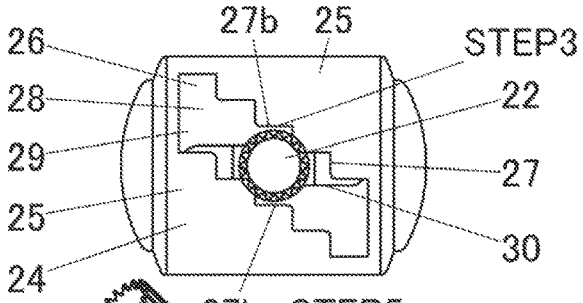
FIG. 8A to 8E show statuses of the elevation control lever of the transmitter according to the embodiment of the present invention.

As shown in FIG. 8A, the elevation control lever 22 of the transmitter 21 is positioned in the step 3, which is provided to a center of the opening 26 defined on the curved surface of the convex part 25. The cutout 30 defined on the curved surface of the rotation member 28 intersects with the step 3, which is provided to the center of the opening 26, and the elevation control lever 22 is positioned at a center of the cutout 30. When the elevation control lever 22 is positioned in the step 3, the motors 11, 12 mounted on the helicopter 1 are activated to rotate at the rotational speed 3 that is the rotational speed of the motors 11, 12 corresponding to the step 3, whereby the rotor 3 is rotated. Rotational speed of the rotor 3 does not reach speed at which the helicopter 1 can climb.

Figure 8B:
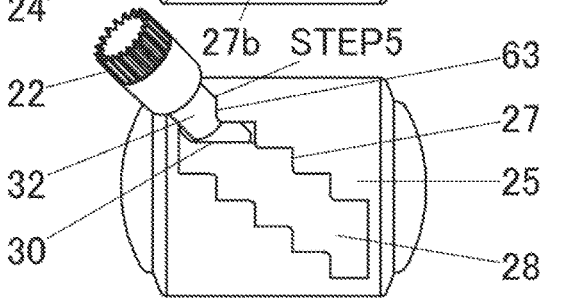

In order to make the helicopter 1 climb, the elevation control lever 22 is tilted to the position of the step 5 along the edge of the opening 26, as shown in FIG. 8B. The rotation member 28 is rotated upward, and the stick part 32 of the elevation control lever 22 is moved in the cutout 30 leftward to reach a vicinity of an end of the cutout 30. At this moment, the elevation control lever 22 is going to return to rightward due to the restoring force of the elastic member 34. However the stick part 32 is blocked and held at the step 5 by a perpendicular side 63 of the step 5. When the motors 11, 12, mounted on the helicopter 1, are set to the rotational speed 5 that is the higher rotational speed than the rotational speed 3 corresponding to the step 3, the helicopter 1 climbs.

Figure 8C:
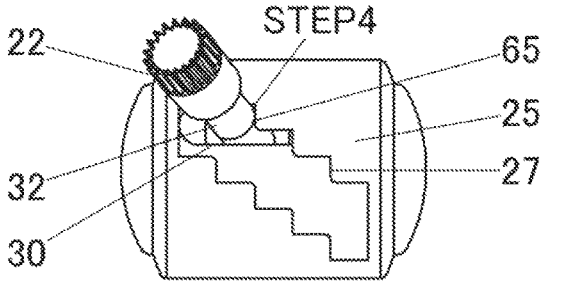

In a state where the elevation control lever 22 is held at the step 5, the helicopter 1 continues to climb and may crash into a ceiling. Therefore, the elevation control lever 22 is tilted by the user to the position of the step 4, which is one step lower than the step 5, along the upper edge of the opening 26, as shown in FIG. 8C. The elevation control lever 22 is going to return rightward due to the restoring force of the elastic member 34. However the stick part 32 is blocked and held at the step 4 by the perpendicular side 65 of the step 4. When the motors 11, 12, mounted on the helicopter 1, are set to the rotational speed 4 that is the lower rotational speed than the rotational speed 5 corresponding to the step 5, the helicopter 1 remains hovering.

When lowering the helicopter 1 in hovering flight, if the elevation control lever 22 is tilted to the lower right direction with a quick motion, the rotational speed of the rotor 3 is significantly reduced due to significant reduction of the rotational speeds of the motors 11, 12 mounted on the helicopter 1, the helicopter 1 may crash into the ground. In order to prevent the crash, the elevation control lever 22 is tilted gradually to the lower right direction along the edge of the opening 26, whereby the height of the helicopter 1 in hovering flight descends gradually.

First, the elevation control lever 22 is tilted from the step 4 to the lower right direction along the upper edge of the opening 26 to be moved to the step 3, which is a center among the steps. When the motors 11, 12, mounted on the helicopter 1, are set to the rotational speed 3 that is the lower rotational speed than the rotational speed 4 corresponding to the step 4, the helicopter 1 starts descending gradually.

Figure 8D:
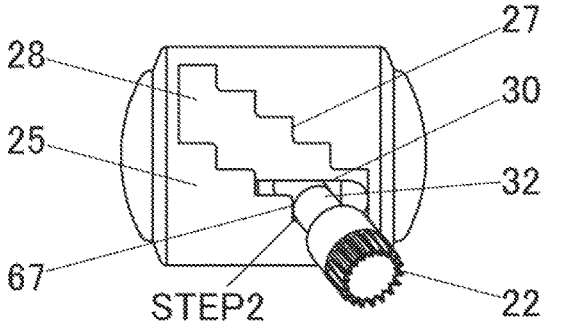

By the elevation control lever 22 being tilted to the step 2 as shown in FIG. 8D, the motors 11, 12, mounted on the helicopter 1, are set to the rotational speed 2 that is the lower rotational speed than the rotational speed 3 corresponding to the step 3, the helicopter 1 descends further.

Figure 8E:
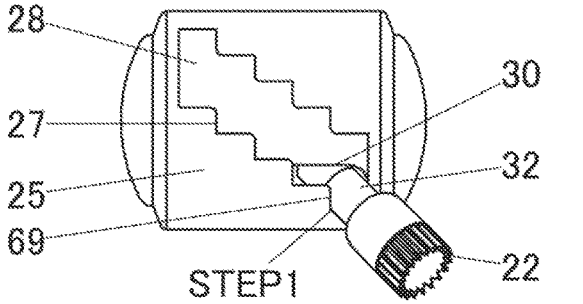

After the helicopter 1 lands using the methods described herein, the elevation control lever 22 is tilted to the step 1 as shown in FIG. 8E. Whereby the rotational speeds of the motors 11, 12 mounted on the helicopter 1 are set to the rotational speed 1, thus the motors 11, 12 are stopped.

With the present invention, there is provided the transmitter that facilitates control of such as hovering and landing of the toy flying object.

Note that the invention is not limited to the embodiment that has been described heretofore and hence can be freely modified or improved without departing from the spirit and scope of the invention.

What is claimed is:

1. A transmitter comprising:

a lever for controlling a flight height of a flying object;

a cover having an opening through which a stick part of the lever passes; and a plurality of steps formed on each of upper and lower edges of the opening, wherein each of the plurality of steps include a lateral side and a perpendicular side, wherein the lateral sides of the plurality of steps formed at the upper edge are parallel to the lateral sides formed at the lower edge of the opening, wherein the lateral sides and the perpendicular sides of the plurality of steps are arranged alternately, wherein the opening is formed in a diagonal direction, relative to the lateral and perpendicular sides, by the plurality of steps being continuously arranged at each of the upper and lower edges thereof, wherein a length of each of a plurality of the perpendicular sides is shorter than a diameter of the stick part, wherein long perpendicular sides, which are longer than each of the perpendicular sides, extend parallel to one another on opposite sides of the opening, and wherein a rotational speed of a motor of the flying object changes according to a position of the lever relative to the plurality of steps along the diagonal direction.

2. The transmitter of claim 1, wherein the perpendicular sides and the lateral sides are arranged adjacently to meet at right angles.

3. The transmitter of claim 1, wherein a rotation member having a curved surface is disposed on a backside of the cover, and wherein a part of the cover is formed into the curved surface which overlaps the curved surface of the rotation member.

4. The transmitter of claim 3, wherein a curvature of the curved surface of the cover is the same as the curvature of the curved surface of the rotation member.

5. The transmitter of claim 3, wherein a cutout extending to a left/right direction, through which the lever passes, is formed in the rotation member.

6. The transmitter of claim 1, wherein a support part is disposed at a proximal end of the lever, wherein an elastic member is disposed at the support part, and wherein a restoring force for returning the lever to a left/right direction is generated by the elastic member when the lever is tilted to the left/right direction.

7. The transmitter of claim 2, wherein a support part is disposed at a proximal end of the lever, wherein an elastic member is disposed at the support part, and wherein a restoring force for returning the lever to a left/right direction is generated by the elastic member when the lever is tilted to the left/right direction.

8. The transmitter of claim 3, wherein a support part is disposed at a proximal end of the lever, wherein an elastic member is disposed at the support part, and wherein a restoring force for returning the lever to a left/right direction is generated by the elastic member when the lever is tilted to the left/right direction.

9. The transmitter of claim 4, wherein a support part is disposed at a proximal end of the lever, wherein an elastic member is disposed at the support part, and wherein a restoring force for returning the lever to a left/right direction is generated by the elastic member when the lever is tilted to the left/right direction.

10. The transmitter of claim 5, wherein a support part is disposed at a proximal end of the lever, wherein an elastic member is disposed at the support part, and wherein a restoring force for returning the lever to the left/right direction is generated by the elastic member when the lever is tilted to the left/right direction.

* * * * *